US009809373B2

(12) United States Patent
Gallimore

(10) Patent No.: US 9,809,373 B2
(45) Date of Patent: Nov. 7, 2017

(54) FOOD CONTAINER WITH INTEGRAL CONDIMENT CUP

(71) Applicants: Galligreen Corporation, Toronto, Ontario, CA (US); Gallimore Products (USA) Inc., Buffalo, NY (US)

(72) Inventor: Gamila Gallimore, Toronto (CA)

(73) Assignees: GALLIGREEN CORPORATION, Ontario (CA); GALLIMORE PRODUCTS (USA) INC., Buffalo, NY (US)

( * ) Notice: Subject to any disclaimer, the term of this patent is extended or adjusted under 35 U.S.C. 154(b) by 0 days.

(21) Appl. No.: 15/086,267

(22) Filed: Mar. 31, 2016

(65) Prior Publication Data

US 2017/0107043 A1 Apr. 20, 2017

Related U.S. Application Data

(60) Provisional application No. 62/243,884, filed on Oct. 20, 2015.

(51) Int. Cl.

| | |
|---|---|
| ***B65D 81/32*** | (2006.01) |
| ***B65D 5/48*** | (2006.01) |
| ***B65D 5/10*** | (2006.01) |
| ***B65D 5/00*** | (2006.01) |
| ***B65D 5/02*** | (2006.01) |
| ***B65D 5/36*** | (2006.01) |

(52) U.S. Cl.

CPC ..... *B65D 81/3205* (2013.01); *B65D 5/008* (2013.01); *B65D 5/029* (2013.01); *B65D 5/0227* (2013.01); *B65D 5/0281* (2013.01); *B65D 5/10* (2013.01); *B65D 5/3621* (2013.01); *B65D 5/48002* (2013.01); *B65D 81/32* (2013.01)

(58) Field of Classification Search

CPC ... B65D 81/3205; B65D 5/10; B65D 5/48002
USPC ..... 229/120.09, 902, 904, 906; 99/426, 449
See application file for complete search history.

(56) References Cited

U.S. PATENT DOCUMENTS 4,955,528 A * 9/1990 Schluckebier ..... B65D 5/48002 229/120.18
5,540,333 A 7/1996 Gonzalez et al.
6,216,946 B1 4/2001 Cai
(Continued)

FOREIGN PATENT DOCUMENTS

CA 2336449 A1 * 9/2001 ..... B65D 5/008

*Primary Examiner* — Christopher Demeree
(74) *Attorney, Agent, or Firm* — Pearne & Gordon LLP

(57) ABSTRACT

A container for a single serving of ready-to-eat food includes opposing side walls, an open top and a cup integral with at least one of the side walls and protruding into the interior of the container. The cup is used to dispense a condiment to accompany the food. The cup includes at least one first cup wall that is configured to fold against the at least one side wall to dispose the cup in a closed position, and to unfold to open the cup into the interior of the container. The cup is urged towards the open and closed position by an overcenter mode of operation whereby partially opening or closing the cup initially encounters resistance, which causes connected container walls to bow; continued opening or closing past the overcenter point allows container walls to flatten, thereby urging the cup towards the open or shut position.

17 Claims, 10 Drawing Sheets

(56) References Cited

U.S. PATENT DOCUMENTS

| | | | | |
|---|---|---|---|---|
| 7,140,532 | B2 * | 11/2006 | Holt | B65D 5/0209 229/120.13 |
| 8,505,807 | B2 | 8/2013 | Herman | |

* cited by examiner

FOOD CONTAINER WITH INTEGRAL CONDIMENT CUP

This application claims priority based on U.S. Patent Application No. 62/243,884 entitled "CONTAINER WITH INTEGRAL CONDIMENT CUP" filed Oct. 20, 2015, which is herein incorporated by reference.

FIELD OF THE INVENTION

The present invention relates to collapsible, disposable containers of the type typically used for providing individual ready to eat single serve portions of food. More particularly, invention relates to an open—topped container of the type which is collapsible for transport and storage.

BACKGROUND

The restaurant and food industry makes widespread use of collapsible, disposable containers for serving ready to eat portions of foods such as French fries. Typically, a serving container is formed from a cardboard blank, which can be at least partially assembled, pre-folded and shipped to the customer in a flattened pre-assembled or partially assembled form. The flattened container may be opened on-site (for example, at a restaurant or the like) to form an open-topped serving container which can be filled with a serving of food or other product. In most cases, further assembly of the container is not required apart from opening the container from a flattened and folded form into a three-dimensional container. Single-serve containers are typically fabricated from a semi-rigid material such as cardboard, which may be coated with a waterproof or water resistant coating on one or both sides.

A convenient configuration for a preformed open-topped container of this type is one that is generally rectangular with a tapered configuration to permit stacking of opened containers, both before these are filled with food portion and for disposal after use. The open top permits filling of the container from above and also for food to be easily removed from the container by the consumer.

Certain food articles such as French fries are typically served with a condiment such as ketchup. Condiments are often added directly to the foodstuff within the container. However, this can lead to leakage, sogginess and other problems. It is often preferable to provide the condiment separately to allow the consumer to dip pieces one at a time. However, providing a condiment in a separate cup is also problematic. It has been proposed to integrate a small condiment cup or similar holder with a larger food container, such that both the primary food article and the condiment may be served to the consumer in a single container unit. For example, see U.S. Pat. No. 8,505,807 to Herman, U.S. Pat. No. 5,540,333 to Gonzalez et al. and U.S. Pat. No. 6,216,946 to Cai.

SUMMARY

According to one aspect, the invention relates to a container comprising side walls, an open top and a cup integral with at least one of said side walls. The cup protrudes at least partially into the interior of the container body for holding a relatively small portion, in relation to the volume of the container, of a substance such as a condiment. The cup can be unfolded to protrude into the interior of the container when the container is opened. When unfolded into an open configuration, the cup is at least partially positioned within the inside of the container body for easy access from the main container opening. The cup comprises at least one first cup wall that is configured to fold against a side wall of the container. Folding the cup wall against the container wall folds the cup into a closed position, while unfolding the cup wall away from the container wall opens the cup to protrude into the interior of the container whereby a portion of the wall of the container forms a wall of the cup.

The invention further relates to a blank comprising a sheet of semi-rigid material configured to form the container as described herein.

It will be seen that although the present example described herein relates to a container for serving food, the present container is not limited to this use but may be used for holding any suitable article or product.

Directional references herein such as "up", "down", "horizontal" and the like are used purely for convenience of description and do not limit the scope of the invention described herein. Furthermore, any dimensions provided herein are presented merely by way of an example and unless otherwise specified do not limit the scope of the invention.

BRIEF DESCRIPTION OF THE DRAWINGS

FIGS. 8A through 8C provide plan views from above, showing an opening sequence of the cup in which FIG. 8A shows the cup in a closed (inwardly folded) position, FIG. 8B shows the cup in a partially open position and FIG. 8C shows the cup in a fully open position. The outward bowing of the container walls has been exaggerated in FIG. 8B.

DETAILED DESCRIPTION

The present invention is described in the context of a preferred use as a food container. However, it will be seen that the invention may be used for holding other products.

Figure 1:
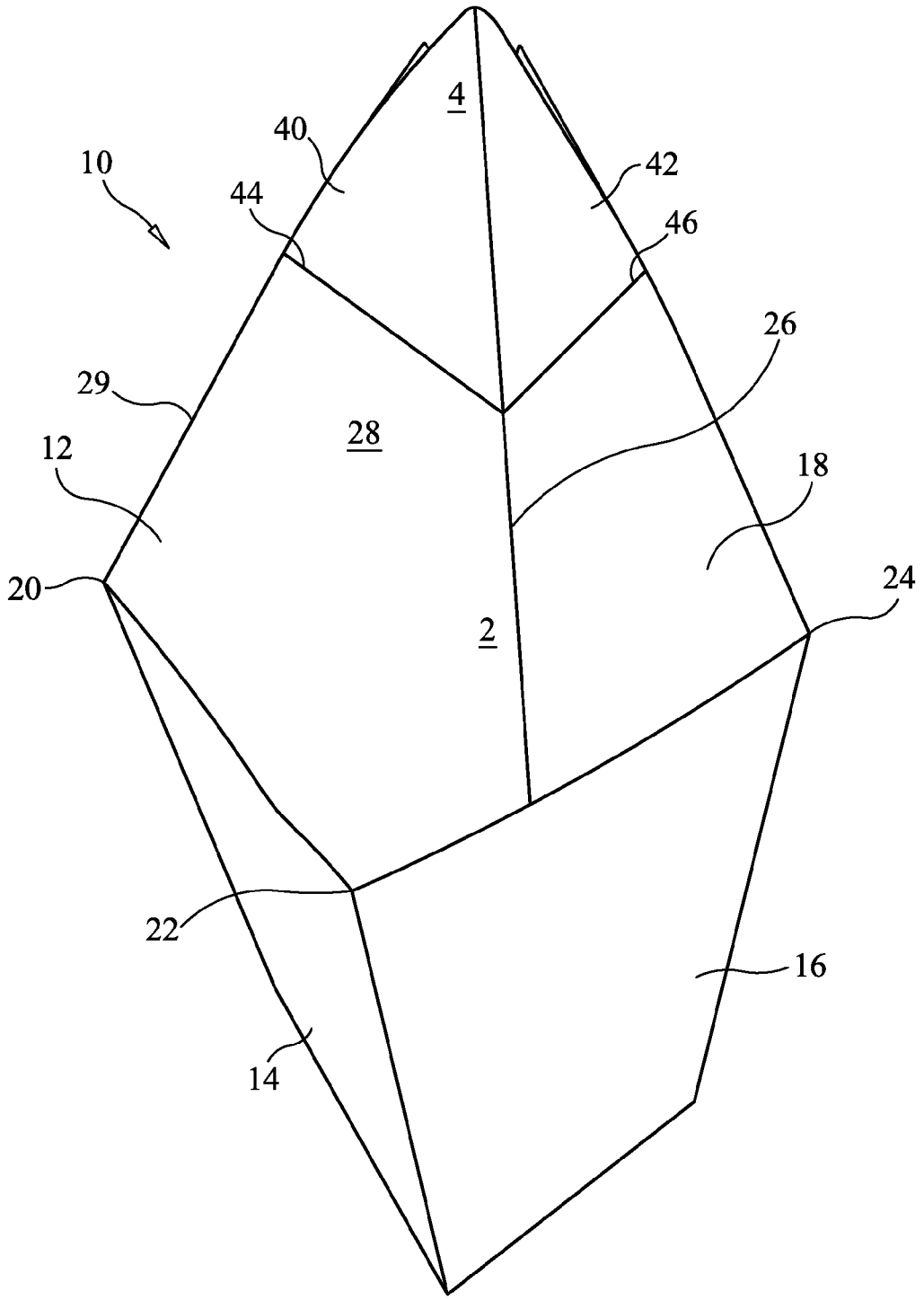
FIG. 1 is a perspective view from the front and above of a food container according to the present invention, with the condiment cup closed.
Figure 2:
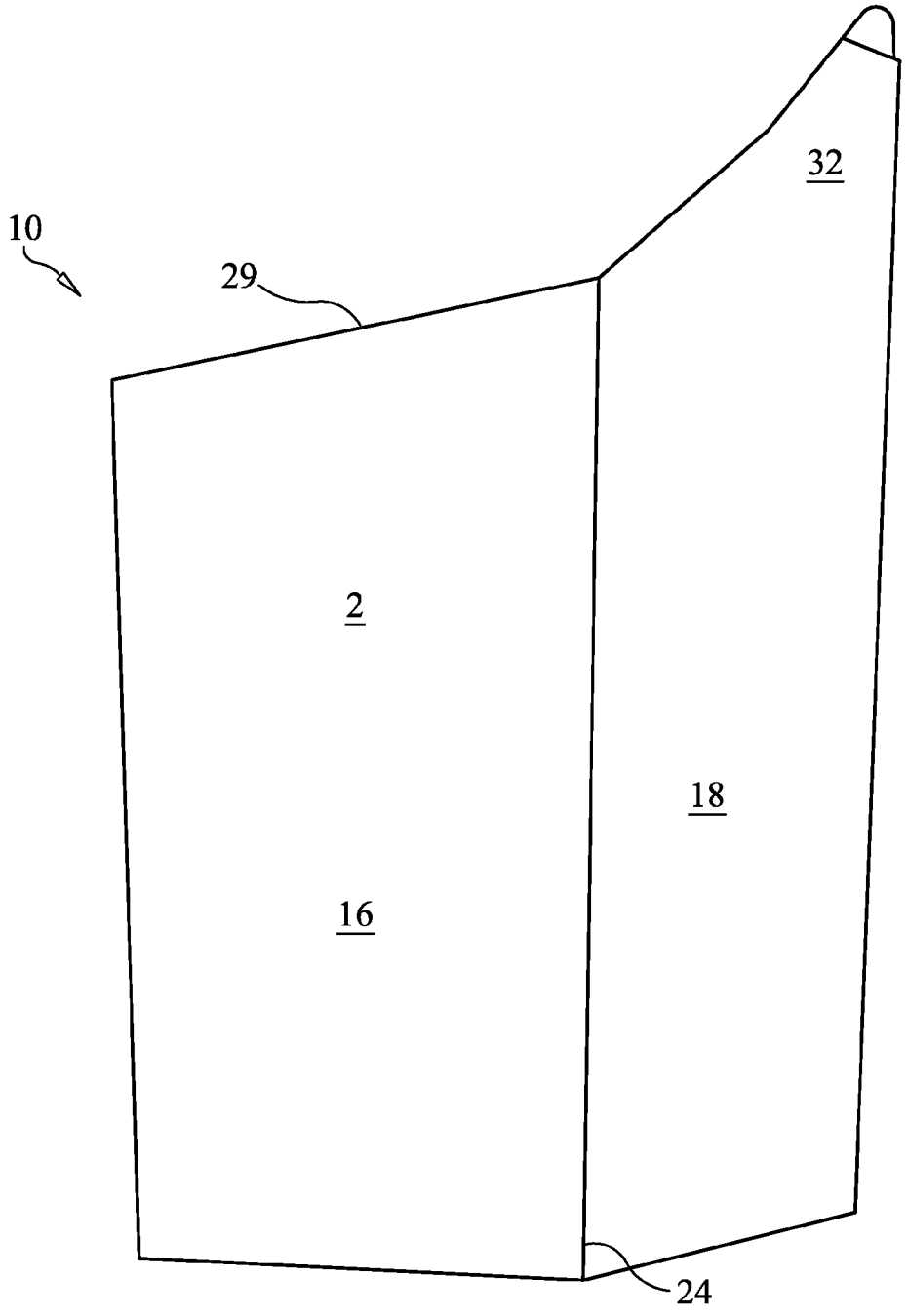
FIG. 2 is a side elevational view of the container.
Figure 3:
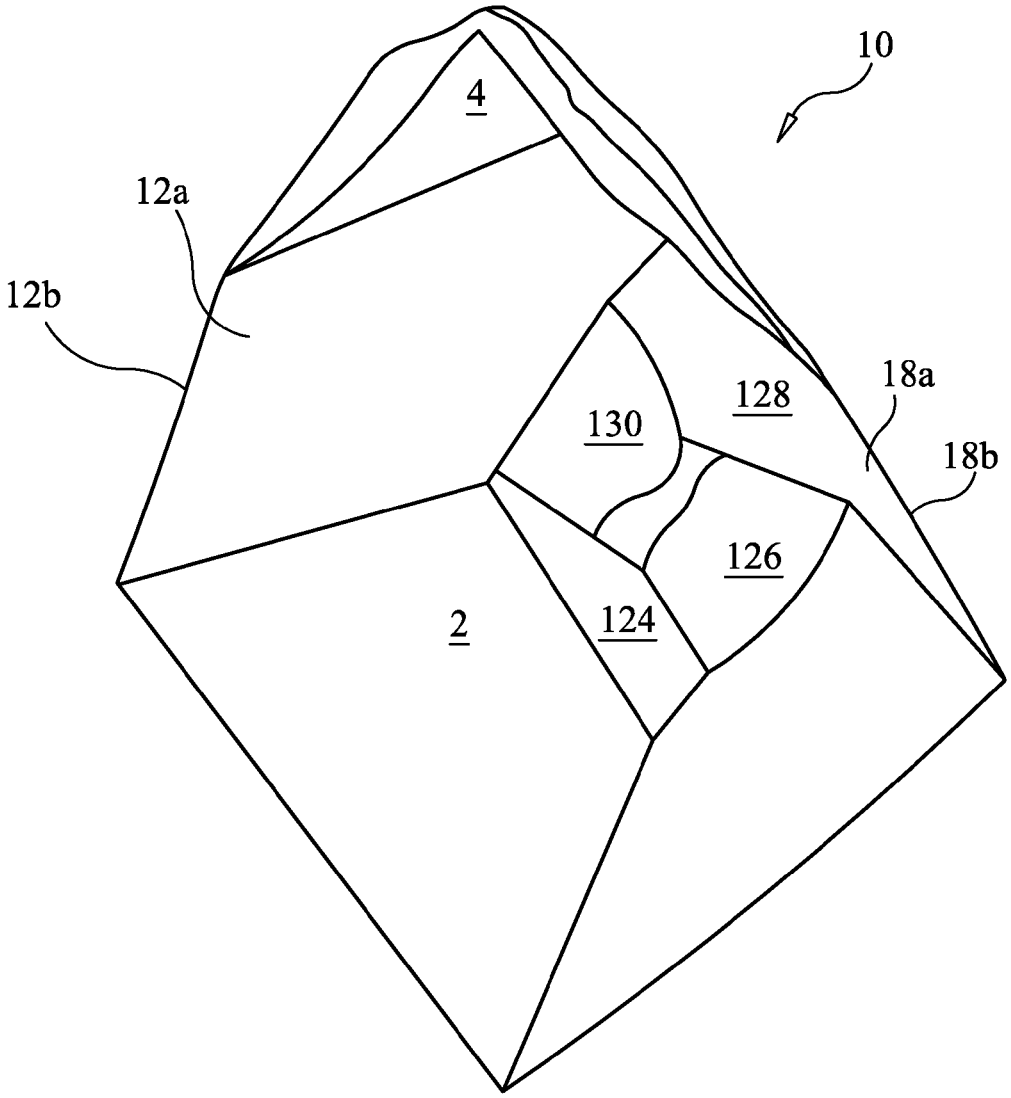
FIG. 3 is a plan view from above of the container, with the condiment cup in the closed position.

Turning to FIGS. 1-3, a food container 10 is shown, comprising a container body 2 and integral condiment cup 4. The cup 4 is shown in these views in the closed position, prior to receiving a condiment therein. Container 10 may be fabricated from a semi rigid, resilient material such as paperboard or cardboard, which is optionally coated on the outside and/or inside to be water and/or grease resistant.

Container 10 comprises an open topped, tapering rectangular configuration defined by walls 12, 14, 16 and 18 respectively, an open top 28 and a floor 30, which is seen in FIG. 3. Walls 14 and 16 form the forward portion of container 10 and walls 12 and 18 define the rearward portion thereof. The various walls meet at folds 20, 22, 24 and 26 respectively. The container tapers slightly outwardly and upwardly, whereby the opened containers may be stacked when condiment cup 4 is closed.

Floor 30 is formed by four overlapping flaps 124, 126, 128 and 130, as discussed below. In FIG. 3, these flaps are shown in a partially closed position to more clearly delineate the individual flaps. In use, floor 30 would normally be substantially or fully closed to prevent leakage.

The open top 28 of container 10 is defined by a continuous upper rim 29 that surrounds open top 28 when container 10 is assembled. Rim 29, which consists of the upper edges of walls 12-18, slopes downwardly and forwardly towards the front of container 10 whereby the container opening 28 angles downwardly to thereby increase the size of opening 28 and improve user access. A forward portion of opening 28 of container 10 may be level or have a slight downward slope. Rim 29 at the rear portion of container 10 slopes steeply upwardly to define an upwardly-projecting, peak-like rear projection 32 formed by rear walls 12 and 18, where these project upwardly in two triangular regions. Projection 32 comprises a V-shaped cross section defined by the respective walls 12 and 18 that form a valley meeting at fold 26. Projection 32 defines the rear wall of condiment cup 4 as described below.

The entirety of rear wall 18 and a portion of rear wall 12 are formed from double layers of cardboard, comprising inner layers 12*a* and 18*a* respectively, and outer layers 12*b* and 18*b* respectively. Projection 32 is thus defined by double wall layers of cardboard. At the region of projection 32, the respective inner and outer layers 12*a* and 12*b* and 18*a* and 18*b* are not adhered together and may be separated from each other. As described below, the respective inner layers at this location can be folded away from the respective outer layers to form a condiment cup 4 that projects into the interior of container 10. Condiment cup 4 is thus defined by inner walls 12*a* and 18*a* and outer walls 12*b* and 18*b*, when these are separated from each other.

Figure 4:
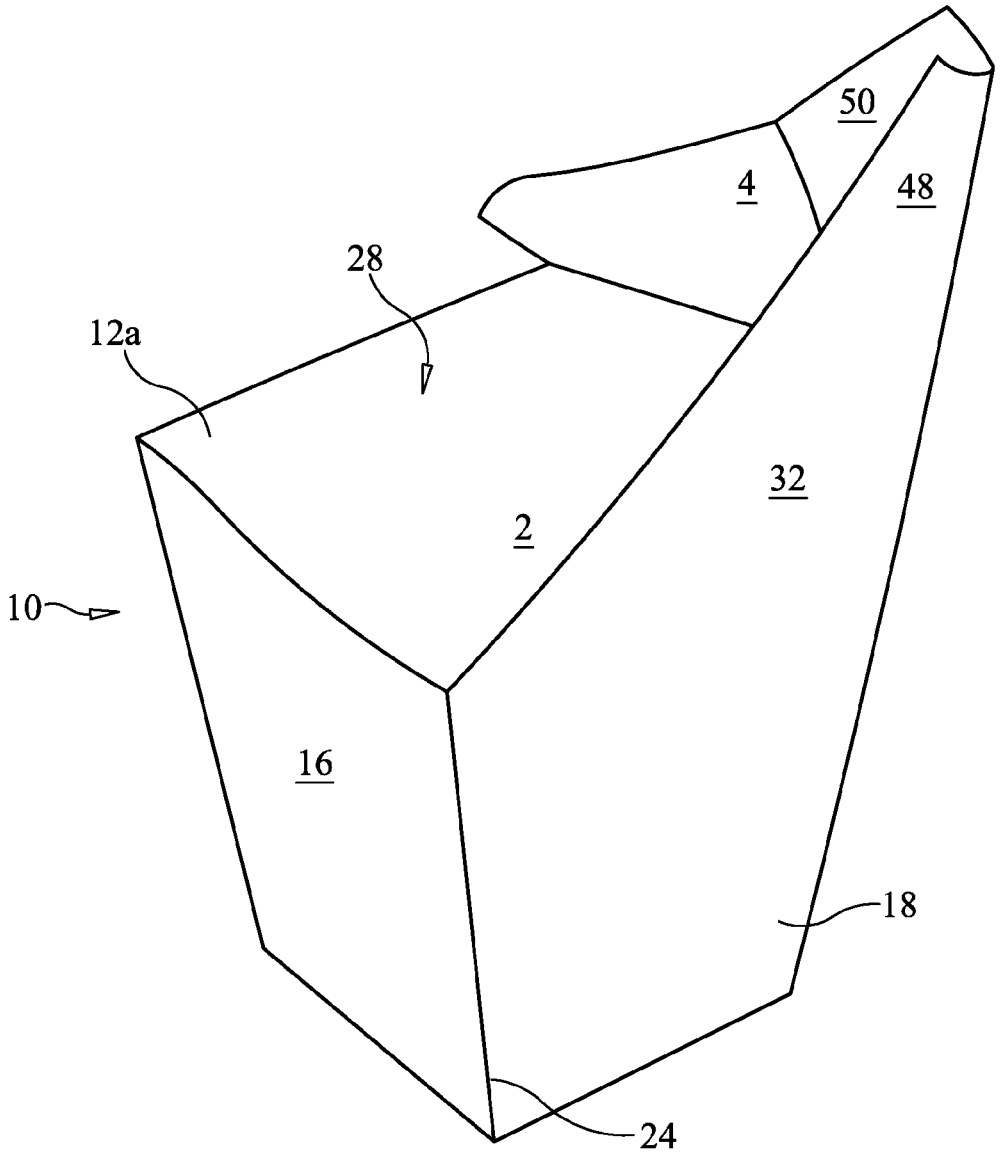
FIG. 4 is a perspective view from above, showing the condiment cup in the open position for receiving a condiment.
Figure 5:
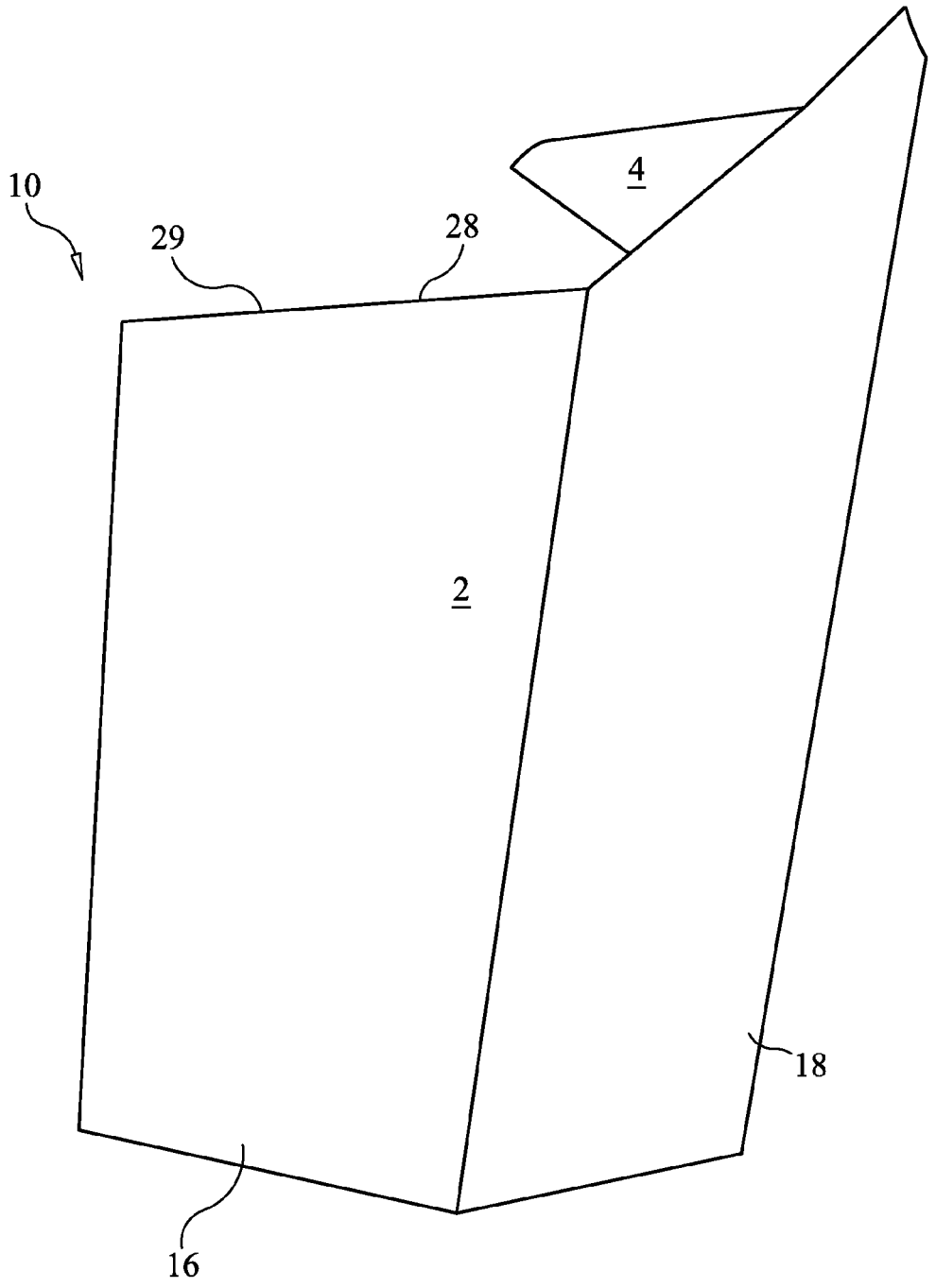
FIG. 5 is a side elevational view of the condiment holder in the open position.
Figure 6:
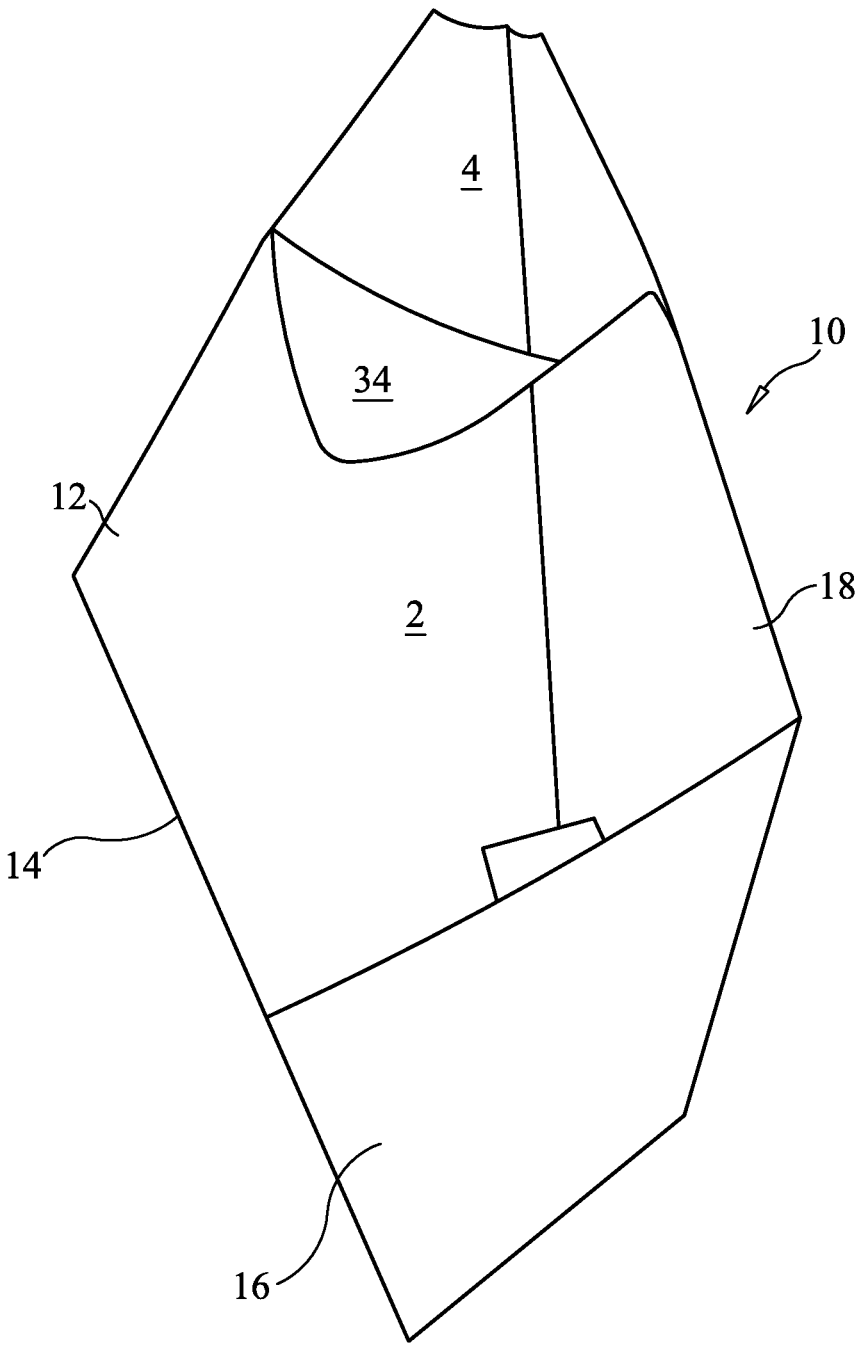
FIG. 6 is a perspective view from above, in the open position.

Turning to FIGS. 4-6, container 10 is shown with the condiment cup 4 in the open position. In this position, condiment cup 4 opens upwardly to hold a condiment therein (not shown).

A front (inner) wall of condiment cup 4 is defined by opposing triangular flaps 40 and 42 (see FIG. 1), which form the uppermost regions of inner walls 12*a* and 18*a* respectively. Flaps 40 and 42 form an upwardly projecting tongue when cup 4 is unfolded into the interior of container 10, to receive a product therein, Flaps 40 and 42 are defined by fold lines 44 and 46 respectively, which delineate flaps 40 and 42 from the respective inner walls 12*a* and 18*a* respectively. Flaps 40 and 42 meet at central fold 26 (see FIG. 1).

The rear wall of condiment cup 4 is defined by truncated triangular regions 48 and 50 of walls 18 and 12. Regions 48 and 50 form the uppermost portions of outer walls 18*b* and 12*b* respectively. Regions 48 and 50 are continuous with the respective outer walls and are not delineated by a fold line or other specifically defined boundary. The uppermost edge of regions 48 and 50 are scalloped downwardly to improve user access to cup 4 to facilitate opening of cup 4 from the closed position.

Figure 7:
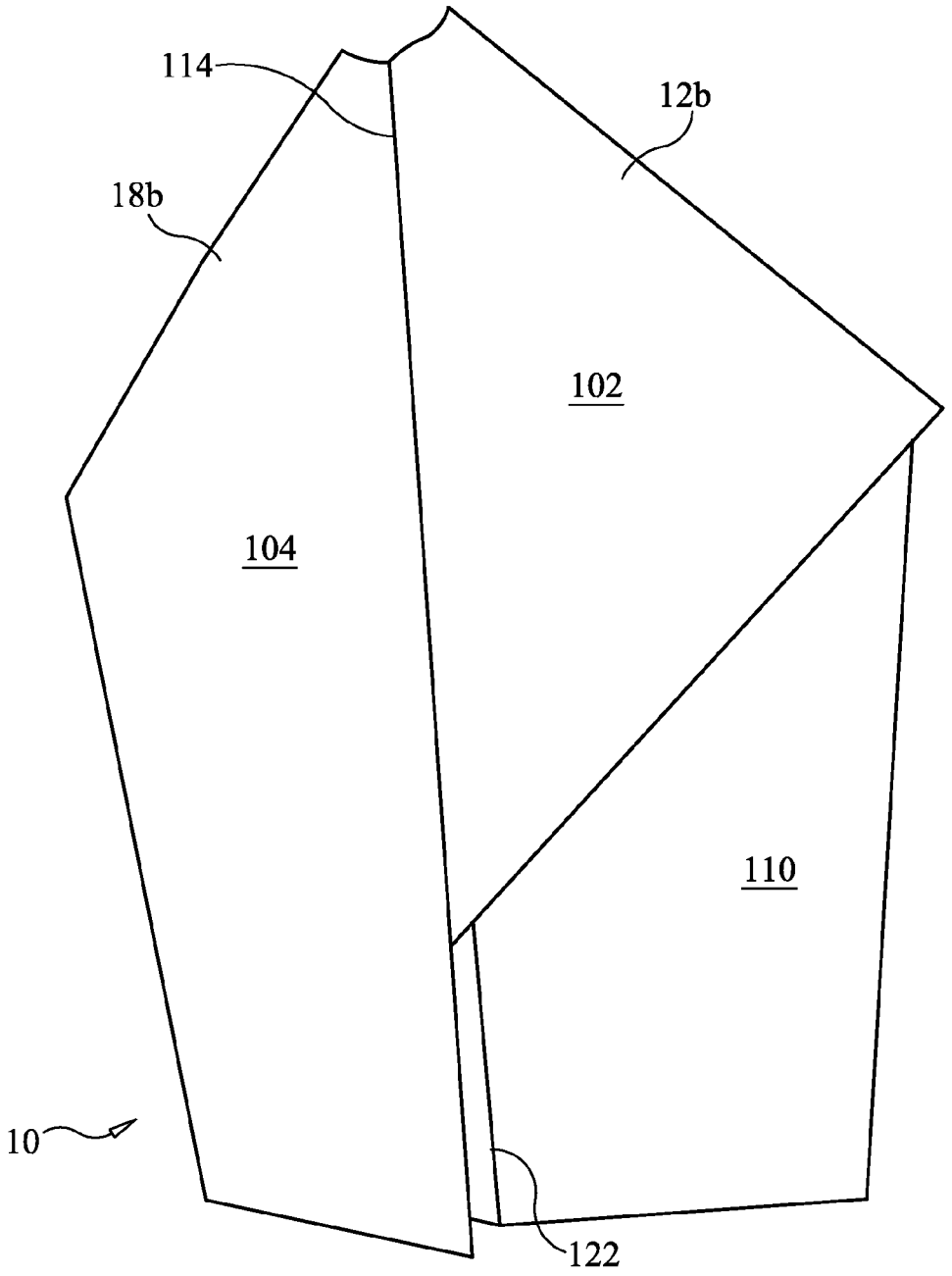
FIG. 7 is a plan view showing the container in a folded position.

In use, container 10 is normally supplied to a user in an assembled and flattened configuration as shown FIG. 7. In this configuration, walls 16 and 18 are continuous and planar with each other and likewise walls 12 and 14 are continuous and planar with each other. Container 10 may be opened to form the open position of FIGS. 1-6, wherein the respective walls 12-18 are at right angles relative to the adjacent walls.

When container 10 is unfolded into the open position, condiment cup 4 is initially disposed in the closed position shown in FIGS. 1-3. Typically, container 10 will then be filled with an individual serving of food such as French fries. The condiment cup 4 may then be opened into the position shown in FIGS. 4-6 to receive a condiment therein. For this purpose, the user urges flaps 40 and 42 forwardly, by contacting the uppermost portions thereof where these are exposed by the downwardly scalloped edges of regions 48 and 50. This action opens up cup 4 to receive a condiment or other foodstuff.

Figure 8A:
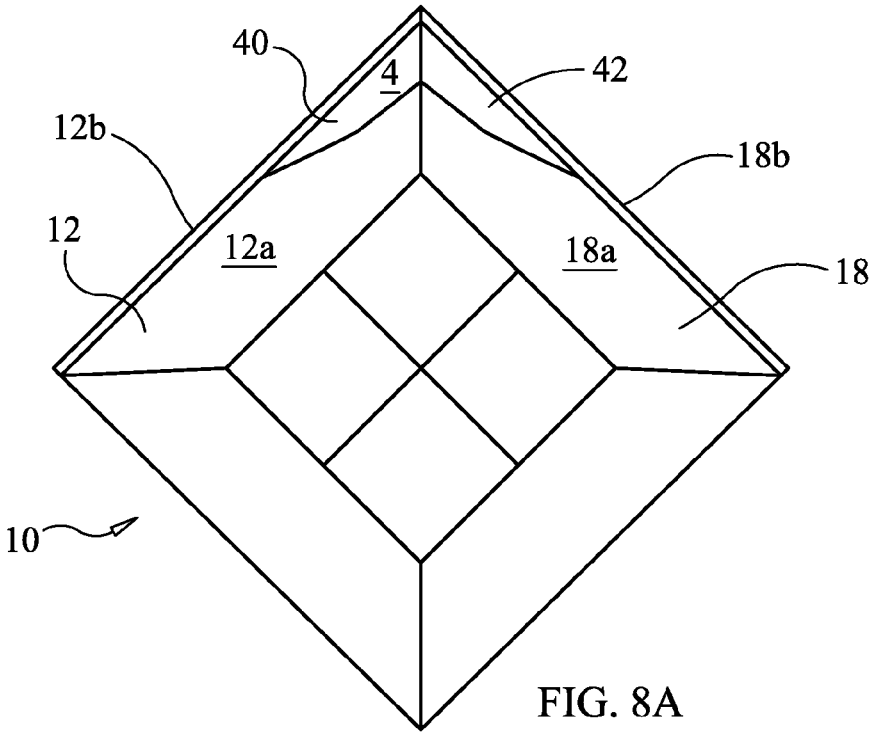
Figure 8B:
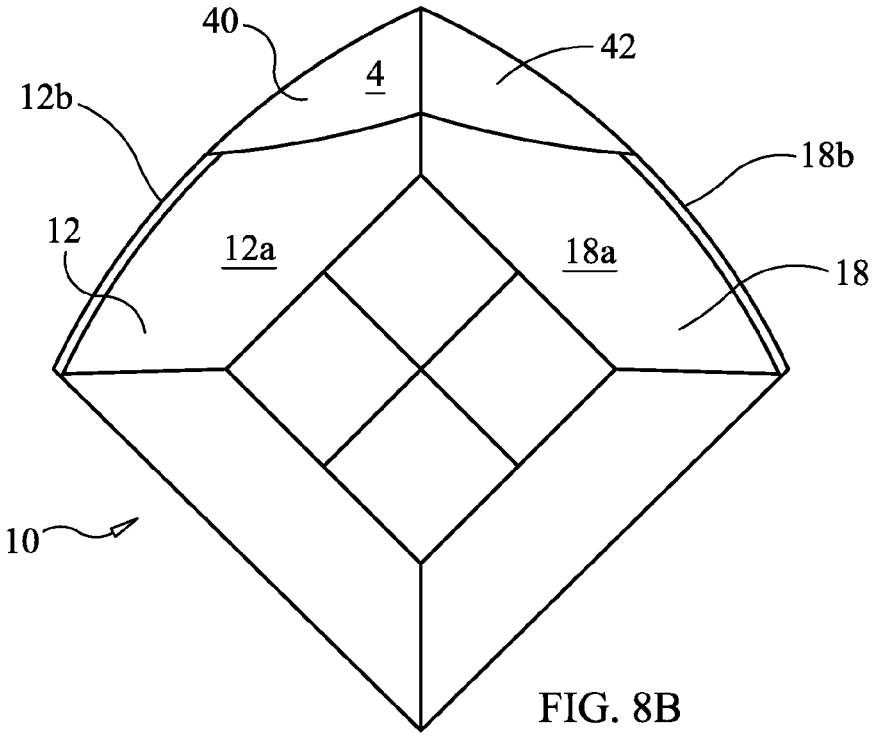
Figure 8C:
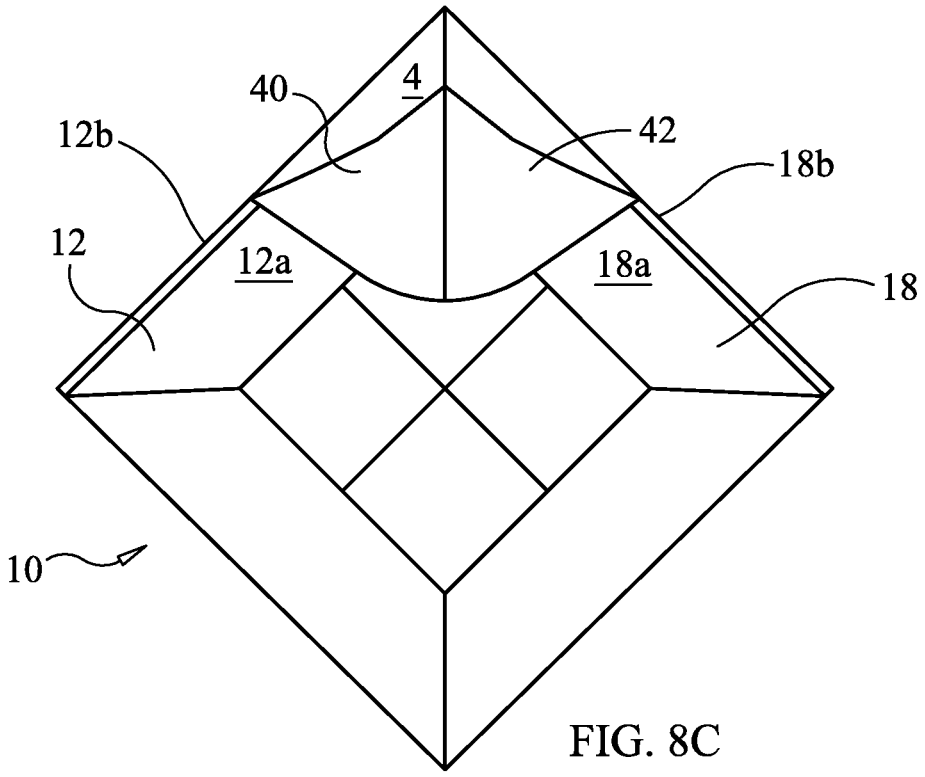

As seen in detail in FIGS. 8A through 8C, cup 4 is urged towards either of the closed or open positions by an over-center mode of action. According to this mode of action, flaps 40 and 42 become biased towards the fully open position, once these have been urged past the overcenter position. Likewise, flaps 40 and 42 become biased towards the closed position, once these are urged past the overcenter position towards the closed position. The over center operation is achieved by the resiliency of walls 12 and 18. Walls 12 and 18 comprise two layers of cardboard which increases their rigidity and enhances the over center biasing effect exerted when these walls flex as cup 4 is urged towards the open or closed positions. The extent of overlapping material need not cover the entirety of walls 12 and 18, but in the present case it these walls comprise a double layer adjacent to all or substantial upper portions thereof adjacent to upper rim 29 when cup 4 is closed. The double wall region thus provides a stiffening effect along substantially the full extent of rim 29 where this traverses walls 12 and 18.

FIG. 8A depicts container 10 with integral cup 4 in the closed position. In this configuration, cup walls 12*a* and 18*a* are flush with container walls 12 and 18 respectively. Container walls 12 and 18 are planar in this configuration. FIG. 8B depicts container 10 with integral cup 4 in a partially open position, approximately midway between open and closed. In this configuration, cup walls 12*a* and 18*a* are spaced apart from container walls 12 and 18.

Furthermore, as cup walls 12*a* and 18*a* are brought into planar alignment with each other as cup 4 is opened, the respective cup walls exert an outward force on container walls 12 and 18; this causes container walls 12 and 18 to bow outwardly, which is shown in an exaggerated form in FIG. 8B. The maximum outward bowing is achieved when cup walls 12*a* and 18*a* are in planar alignment. The outward bowing of container walls 12 and 18 causes them to exert a countervailing inward force against cup walls 12*a* and 18 which urges them towards a folded position. As the cup is opened, container walls 12 and 18 become progressively more outwardly bowed until they reach their maximum outward bowing, at the point where cup walls 12*a* and 18*a* are in planar alignment. This is the "overcenter" position. Continued opening of the cup walls then allows container walls 12 and 18 to start to straighten, which urges cup 4 towards the fully open position ,which is reached when container walls 12 and 18 are once again planar. As a result, once urged past the overcenter position, cup 4 effectively "snaps" into the fully open position. Cup 4 is securely retained in the fully open position by the container walls 12 and 18 resisting any bowing in either direction.

Closing of cup 4 follows the reverse sequence as its opening. As cup 4 is urged towards the closed configuration, container walls 12 and 18 are caused to bow outwardly until they reach their maximum outward bowing at the overcenter position. Continued urging of cup 4 towards the closed position then causes container walls 12 and 18 to flex back towards the planar position, thereby "snapping" cup 4 shut and retaining it in the closed position until opened. In this manner, cup 4 is securely held in either of the fully closed or fully open position.

As flaps 40 and 42 are urged towards the open or open position, this action opens flaps 40 and 42 away from each other, thereby bowing walls 12 and 18 outwardly. The double wall structure of walls 12 and 18 increases their rigidity. This has the effect of allowing these walls to apply a relatively large force tending to resist arcuate bending. These walls are bowed outwardly in response to the outward urging applied when cup 4 is opened or closed. Walls 12 and 18 are biased against a bending force applied to them and apply a countervailing force as these are urged into an arcuate configuration. The resulting forces tend to urge flaps 40 and 42 into the fully open or fully closed positions, since when in these positions, the respective walls 12 and 18 are planar. The result is that as cup 4 is opened from a closed position, it encounters increasing resistance as walls 12 and 18 are bowed, until approximately the midway point when continued opening starts to draw flaps 40 and 42 together. At this point, which is effectively the overcenter "tipping point", continued opening of cup 4 is urged by the force of walls 12 and 18 reverting towards their planar positions. Accordingly, cup 4 is biased towards the fully closed or fully open position depending on which side of the overcenter tipping point flaps 40 and 42 are positioned.

Figure 9:
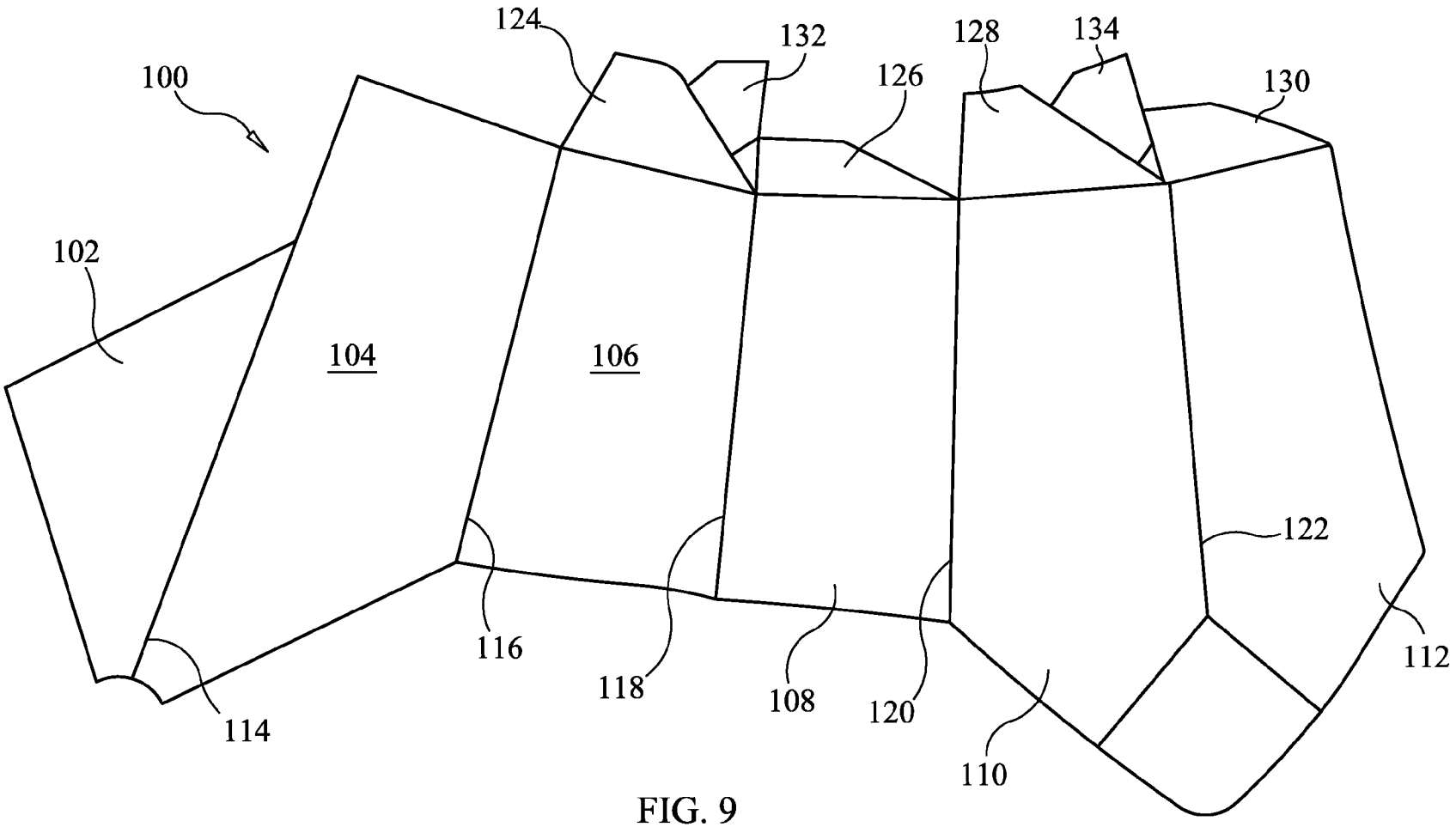
FIG. 9 is a plan view showing a cardboard blank for forming the container, in a substantially flattened and fully open position.

Turning to FIG. 9, a blank 100 is shown in a flattened position for forming into a container 10 as described herein. Blank 100 comprises, viewed from left to right in FIG. 8, triangular flap 102 that forms outer wall 12*b* when folded; trapezoidal panel 104 that forms inner wall 12*a* when folded; trapezoidal panel 106 that forms wall 14 when folded; trapezoidal wall 108 that forms wall 16 when folded; trapezoidal wall 110 that forms inner wall 12*a* when folded; and trapezoidal panel 112 that forms inner wall 18*a* when folded.

The respective panels are joined by folds 114, 116, 118, 120, and 122 along their side edges.

Floor 30 of a container 10 is formed by four bottom flaps 124, 126, 128 and 130 that extend from panels 106, 108, 110 and 112 respectively. The respective bottom flaps are joined by folds to the respective panels. Flaps 124 and 128 in turn comprise protruding sub-flaps 132 and 14, which are configured to allow folding of the assembled container.

Container 10 is assembled by folding blank 100 together whereby panel 102 is folded onto outside surface of panel 110 and secured thereto by an adhesive. Flap 102 is folded to form outer wall 12*b*, panel 110 forms inner wall 12*a*. It will be seen that flap 102 covers only an upper portion of panel 110 whereby outer wall 12*a* forms a portion of wall 12.

The resulting partially assembled blank may be shipped and stored in a folded, flattened configuration as seen in FIG. 7. When ready for use, the container may be unfolded into an open container 10.

In order to seal container 10 against leakage of liquids, a strip of adhesive may be applied along a side edge of panel 112, for contacting panel 104 to thereby form a watertight seal where the blank 100 contacts itself upon assembly into container 10. As well, adhesive may be applied between flaps 128 and 130 and also flaps 124 and 126 to thereby partially assemble floor 30.

The scope of the invention should not be limited by the preferred embodiments set forth in the examples but should be given the broadest interpretation consistent with the description as a whole. The claims are not to be limited to the preferred or exemplified embodiments of the invention.

The invention claimed is:

1. A collapsible container comprising opposing side walls that define an open interior when opened, an open top and a collapsible cup which is integral with at least one of said side walls and protrudes into the interior of said container, wherein said cup comprises first and second cup walls, wherein at least the first cup wall is configured to fold against said at least one side wall to dispose the cup in a closed position, and to unfold to open said cup into the interior of said container, wherein the container is configured to urge the cup into a selected one of the open or closed position by an overcenter operation generated by outward bowing of the at least one side wall as the cup is urged towards the closed or open position through an overcenter position, wherein the overcenter position is partway between fully open and fully closed positions of the cup, wherein the first and second cup walls meet in a central fold line, the first and second cup walls each consisting of a triangular panel which extends from a corresponding one of the side walls to the central fold line, wherein opening the cup urges the panels to diverge where they meet the side walls to bow the side walls outwardly when the container is opened or closed through the over center position.

2. The container of claim 1 wherein said opposing side walls of the container meet in a container wall fold line that is directly opposed to the central fold line of the first and second cup walls, wherein said cup when collapsed nests against the side walls of the container.

3. The container of claim 1 wherein said at least one side wall comprises two layers defined by an outer wall and an inner wall, said inner wall forming the at least one first cup wall.

4. The container of claim 3 wherein said two layers form substantially the entirety of an upper rim of the side walls adjacent to said cup whereby said side walls are stiffened by the double layer construction thereof along the full width thereof relative to a container wherein said side walls are not of a double wall construction along the full width thereof.

5. The container of claim 3 wherein at least one of said inner walls protrudes upwardly above said outer walls to define a contact area for contacting the inner walls to urge them inwardly.

6. The container of claim 1 wherein two of said side walls each comprise two layers each defined by an outer wall and an inner wall, said inner walls forming said first and second cup walls.

7. The container of claim 6 wherein said first and second cup walls each comprise a panel continuous with a corresponding one of the inner walls and defined by a fold line permitting the panel to fold out of the plane of the respective inner wall.

8. The container of claim 1 wherein said container is configured to fold flat in a closed position wherein said walls are essentially parallel to each other.

9. The container of claim 1 wherein the at least one side wall of the container protrudes upwardly in a peak-like projection from others of said side walls, said projection comprising a second wall opposed to the first cup wall.

10. The container of claim 9 wherein two of said side walls of the container protrude upwardly in a peak-like projection from others of said side walls, said projection defining a V-shaped configuration and opposed to the at least one first cup wall.

11. The container of claim 1 wherein the opening of the cup is at least partially surrounded by the opening of the container.

12. A blank comprising a sheet of semi-rigid material configured to form the container of claim 1.

13. A collapsible container comprising opposing side walls that define an open interior when opened, an open top and a collapsible cup which is integral with at least one of said side walls and protrudes into the interior of said container, wherein said cup comprises first and second cup walls, wherein at least the first cup wall is configured to fold against said at least one side wall to dispose the cup in a closed position, and to unfold to open said cup into the interior of said container, wherein two of said side walls each comprise two layers each defined by an outer wall and an inner wall, said inner walls forming said first and second cup walls, said side walls being configured for urging the cup into a selected one of the open or closed position by an overcenter operation generated by outward bowing of said side walls as the cup wall is urged towards the closed or open position through an overcenter position, wherein the overcenter position is partway between fully open and fully closed positions of the container, wherein the first and second cup walls meet in a central fold line, the first and second cup walls each consisting of a triangular panel which extends from a corresponding one of the side walls to the central fold line, wherein opening the cup urges the panels to diverge where they meet the side walls to bow the side walls outwardly when the container is opened or closed through the over center position.

14. The container of claim 13 wherein said container is configured to fold flat in a closed position wherein said walls are essentially parallel to each other.

15. The container of claim 13 wherein the at least one side wall of the container protrudes upwardly in a peak-like projection from others of said side walls, said projection comprising a second wall opposed to the first cup wall.

16. The container of claim 15 wherein two of said side walls of the container protrude upwardly in a peak-like projection from others of said side walls, said projection defining a V-shaped configuration and opposed to the at least one first cup wall.

17. A blank comprising a sheet of semi-rigid material configured to form the container of claim 13.

* * * * *